US009151135B2

(12) United States Patent
Eriksen

(10) Patent No.: US 9,151,135 B2
(45) Date of Patent: Oct. 6, 2015

(54) UNDERWATER STUFFING BOX AND METHOD FOR RUNNING A DRILL STRING THROUGH THE STUFFING BOX

(75) Inventor: Egil Eriksen, Foldrøyhamn (NO)

(73) Assignee: Electrical Subsea & Drilling AS, Straume (NO)

( * ) Notice: Subject to any disclaimer, the term of this patent is extended or adjusted under 35 U.S.C. 154(b) by 632 days.

(21) Appl. No.: 13/522,939

(22) PCT Filed: Jan. 24, 2011

(86) PCT No.: PCT/NO2011/000026

§ 371 (c)(1),
(2), (4) Date: Oct. 19, 2012

(87) PCT Pub. No.: WO2011/093714

PCT Pub. Date: Aug. 4, 2011

(65) Prior Publication Data

US 2013/0056274 A1 Mar. 7, 2013

(30) Foreign Application Priority Data

Jan. 26, 2010 (NO) ..... 20100121

(51) Int. Cl.
*E21B 19/00* (2006.01)
*E21B 33/08* (2006.01)
*E21B 33/035* (2006.01)

(52) U.S. Cl.
CPC ..... *E21B 33/08* (2013.01); *E21B 33/035* (2013.01)

(58) Field of Classification Search
CPC ..... E21B 33/08; E21B 33/043; E21B 33/068; E21B 33/076; E21B 33/035; F16J 15/18; F16J 15/187; F16J 15/028; F16J 15/188
USPC ..... 166/86.2, 87.1, 84.5, 84.1; 251/1.2, 1.3; 175/57
See application file for complete search history.

(56) References Cited

U.S. PATENT DOCUMENTS 3,100,015 A * 8/1963 Regan ..... 166/378
3,490,525 A * 1/1970 Nettles ..... 166/97.1

(Continued)

FOREIGN PATENT DOCUMENTS

GB 2425795 A 11/2006
NO 20090248 7/2010

(Continued)

OTHER PUBLICATIONS

International search report and written opinion for application No. PCT/NO2011/000026 dated Apr. 19, 2011.

*Primary Examiner* — Kenneth L Thompson
*Assistant Examiner* — Michael Wills, III
(74) *Attorney, Agent, or Firm* — Patterson & Sheridan, LLP

(57) ABSTRACT

A cylindrical, hollow stuffing box arranged to be able to take up geometrical differences between drill pipes and tool joints includes an outer housing, an upper and a lower set of support plates and also a sleeve-shaped, flexible sealing element arranged rotationally between said support plates and enclosed by a liquid filled, a pressurized annulus which in a fluid sealing manner is defined by a central part of the stuffing box housing, the outside of the sealing element and said support plates; each of the upper and lower support plate sets comprise two halves connected to an actuator each arranged for radial displacement of the halves; each of the support plate halves comprise a cut-out arranged to be able to encircle a peripheral portion of the drill string; and the inside and the ends of the sealing element comprise cast-in, ceramic elements.

5 Claims, 2 Drawing Sheets

(56) References Cited

U.S. PATENT DOCUMENTS

| | | | | |
|---|---|---|---|---|
| 3,583,480 | A * | 6/1971 | Regan | 166/352 |
| 2005/0061499 | A1* | 3/2005 | Hopper | 166/84.3 |
| 2010/0270746 | A1* | 10/2010 | Van Winkle | 277/322 |
| 2012/0125622 | A1* | 5/2012 | Melancon et al. | 166/339 |

FOREIGN PATENT DOCUMENTS

| | | | |
|---|---|---|---|
| WO | 0022278 | A1 | 4/2000 |
| WO | 2007008085 | A1 | 1/2007 |
| WO | 2010082831 | A1 | 7/2010 |

* cited by examiner

UNDERWATER STUFFING BOX AND METHOD FOR RUNNING A DRILL STRING THROUGH THE STUFFING BOX

FIELD OF THE INVENTION

The invention relates to an underwater stuffing box with an exchangeable, rotating sealing element taking up geometrical differences between passing drill pipes and pipe joints, at the same time as the wear is reduced to a minimum, as stated in the accompanying claim 1.

DESCRIPTION OF THE RELATED ART

The oil industry is currently developing systems for drilling in deep water without the use of risers (Marineriserless drilling). This will increase the water depth that the individual rig may operate in, and give a series of cost and work savings regarding drilling liquid, riser cost, shorter operational time, and that the storage requirement for pipes on the rig is reduced.

A key component to realise such a concept is a hard-wearing underwater stuffing box device sealing against a passing drill string, and allowing the tool joints between the drill pipes having a larger diameter than the pipes, to be moveable through the inside sealing element in the stuffing box, which design must give a reliable seal while the drill string is moving in or out of a subsea well. The useful life for the stuffing box elements shall ensure that wear does not lead to interruption of the drilling operation.

From the patent literature the following prior art is quoted:

GB A 2,425,795 describes a stuffing box rotating together with the drill string, where the seal has an outer pressurised space. Liquid is supplied to the space via a port, the liquid giving pressure assistance to the seal.

NO 20053394 describes a stuffing box for use in well interventions or drilling operations, the stuffing box consisting of a dynamic seal with a sealing unit and a receiver part. The sealing unit consists of three seals, and the spaces between the seals are filled with grease or oil for providing both lubrication and pressure support to the seals.

From prior art it is regarded that a stuffing box with a soft seal is a solution being worked on, but such stuffing boxes are very vulnerable to wear, with subsequent costly replacement.

SUMMARY OF THE INVENTION

The stuffing box housing will be connected to the top of a Blow Out Preventer (BOP) installed on the underwater wellhead equipment of a seabed well in connection with drilling, well completion, or intervention operations. A pressure assisted sealing element internally in the housing squeezes around the drill string, at the same time as the ends of the sealing element are forced against the supporting plates on the over- and underside of the sealing element, so that the stuffing box seals against the well pressure and external sea water pressure during the operation. A hydraulic control system is used to pressurise the annulus between the sealing element around the drill string and the outer housing of the stuffing box in order to provide pressure assistance to the sealing element. In addition the control system supplies the stuffing box with sealing liquid in the interstice behind the support plates when they are in the inner position, so that ingress of particles behind these is prevented and possibly also to actuate hydraulic cylinders attached to the sealing element support plates in the top and bottom of the stuffing box. Preferably, the hydraulic medium will be filtered seawater. The connection to the BOP and the control equipment is not to be considered part of the invention.

A first objective of the invention is to achieve a high wear resistance and a long useful life for the sealing element, so that wear from the drill pipe does not lead to interruption in the drilling operations.

Another objective of the invention is that the wear and sealing element in the stuffing box may be brought up and be installed by means of the drill string, and it is desirable that a drill bit with a reamer shall be able to pass through the stuffing box.

The following features shall contribute to this:

The wear and sealing element, which seals against the drill string, runs centrally through the stuffing box. The wear and sealing element is a pressure assisted polyurethane sleeve having ceramic elements cast in the surfaces exposed to wear. The sleeve rotates with the drill string so that rotational wear between the sealing element and the drill string is eliminated. The hydraulic control system controls the backpressure providing for radial preloading of the sealing element and operates the hydraulic cylinders actuating the support plates of the sealing element. When the sealing element is installed in the stuffing box housing the support plates are in the inner position taking up axial forces, at the same time as they serve as an upper and lower sealing surface for the internal sealing element. Cutouts in the plate halves form a hole in the centre of the stuffing box that the drill string and the tool joints may pass through. When the plate halves are in their inner position there is formed an open space behind these, the open space being pressurised with sealing liquid, filtered seawater from the control system, to counteract ingress of particles. The packer element clamps around and follows the drill string motions to the extent that it moves sideways within the diameter of the centre hole in the support plates.

The drill bit with the reamer has a design and a diameter causing it not to be able to pass through the sealing element. The support plates may be opened for passing through equipment having larger diameter than the tool joints, and the sealing element goes with the drill pipe to the surface when the drill string is pulled out of the well and is also installed in the stuffing box by means of the drill string in connection with the drill string being led into the well. The space behind the support plates that is normally pressurised with sealing liquid, is ventilated via the control system before the plates are pulled back. The solution has several advantages in preference to the prior art;

No mechanical bearing in the stuffing box.

No need for injection of lubricating means. Seawater is used for pressure assistance instead of grease and also for control functions. This is advantageous in relation to environmental spill issues.

The sealing element in the stuffing box "floats" sideways in the stuffing box when the pipe moves in the opening between the support plate halves and shall not withstand side forces from movement in the drill pipe.

It is possible to get a drill bit through the stuffing box without the need for disconnecting the outer housing of the stuffing box.

The sealing element is pulled to the surface with the drill string as a part of the normal drilling operation, without the use of special tools or time-consuming operations. The sealing element will then be available on the surface for inspection and any replacement if needed.

The present application relates in a first aspect to a stuffing box for a drill string, having a replaceable sealing element taking up geometrical differences between passing drill pipes and tool joints, and the stuffing box is characterised by the characteristics in the stated claims.

In another aspect the invention relates to a method for leading a drill bit through the stuffing box wherein;

Prior to installing the drill string from the surface the sealing element is led onto the drill pipe, over the drill bit. The lower support plate in the stuffing box is closed around the drill string when the drill bit has come through the stuffing box, and the sealing element stops against this when it has been pulled into the stuffing box. The support plate above the sealing element is then closed around the drill pipe and the annulus is pressurised with seawater via the control system.

When the drill string is pulled out of the well and the drill bit is to move through the stuffing box, the support plate is opened and the sealing element follows the drill string to the surface and is inspected and replaced if needed.

BRIEF DESCRIPTION OF THE DRAWINGS

In the following is described an example of a preferred embodiment illustrated in the accompanying figures.

DETAILED DESCRIPTION

Figure 1:
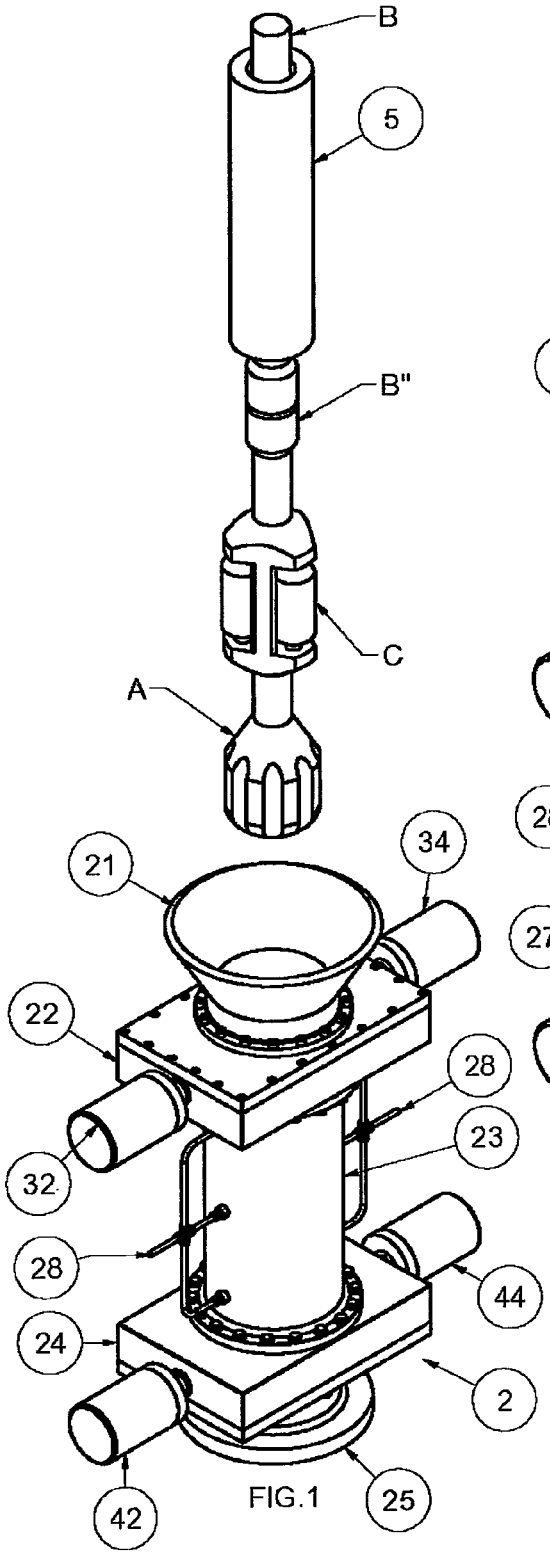
FIG. 1 depicts pulling or installation of a drill string with a drill bit A and a reamer C. The sealing element follows the drill string to or from the surface.

The following reference numerals and letters are used in the Figures;

A Drill bit.
B Drill string—Upper drill pipe.
B' Lower drill pipe.
B" Tool joint
C Reamer.
1 Stuffing box
2 Outer stuffing box housing.
21 Entering cone for stuffing box.
22 Upper part of stuffing box housing.
23 Middle part of stuffing box housing.
24 Lower part of stuffing box housing.
25 Lower flange for connecting to other equipment.
26 Pressurised annulus in middle part of stuffing box housing.
27 Pressure ports in middle part of stuffing box housing.
28 Pipe connections for pressurising the annulus of the stuffing box.
3 Upper set of support plates for the sealing element.
31 Halve of upper support plate for the sealing element.
32 Actuator for halve of upper support plate for the sealing element.
33 Half of upper support plate for the sealing element.
34 Actuator for half of upper support plate for the sealing element.
4 Lower set of support plates for the sealing element.
41 Half of lower support plate for the sealing element.
42 Actuator for half of lower support plate for the sealing element.
43 Half of lower support plate for the sealing element.
44 Actuator for half of lower support plate for the sealing element.
5 Sleeve-shaped, flexible sealing unit in polyurethane with ceramic elements in the wear surfaces.

The stuffing box 1 comprises an outer housing 2 with an entering cone 21 in the upper end, an upper part 22, a middle part 23, a lower part 24, and a lower flange 25 for attachment to other equipment in the lower end, an upper and a lower set of support plates 3 and 4 respectively for the sealing element 5, with an actuator for each plate half, a sleeve-shaped flexible sealing element 5 enclosed by a liquid filled, pressurised annulus 26 between the middle part 23 of the outer housing 2 and the outside of the sealing unit 5. The stuffing box 1 will be equipped with instrumentation to monitor critical parameters, such as pressure, temperature and the like.

A drill string B consists of drill pipes B, B', B" of lengths of 10-12 m joined together, and only one tool joint B" at a time will pass through the stuffing box 1. The sealing element 5 is made of polyurethane which is an elastic material. When the tool joint B" is to pass through the middle of the stuffing box 1, the portion of the sealing element 5 through which the tool joint passes will be squeezed out into the annulus 26 and as soon as the tool joint B" has passed, the sealing element 5 will contract around the pipe. Persistent sealing during operation, with minimal wear on the stuffing box elements is achieved in that the inner packer 5 rotates with the drill string.

Figure 2:
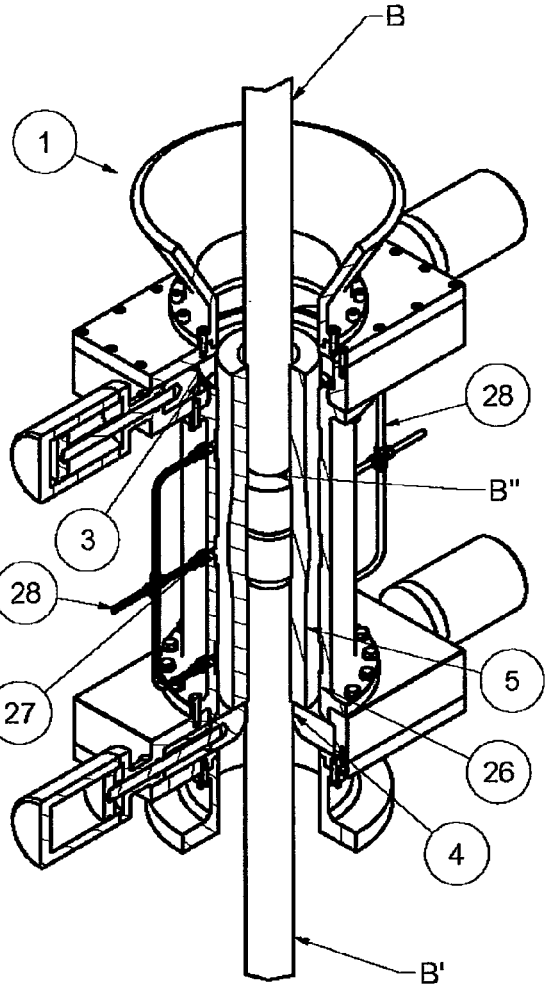
FIG. 2 is a sectioned 3D view of the stuffing box with the sealing element. The upper set of support plates for the sealing element is shown in the outer position and the lower plates are shown in the inner position. An upper drill pipe B connected to a lower drill pipe B' provided with a tool joint B" runs axially in the stuffing box. The diameter of the tool joint B" exceeds that of the drill pipes B, B'.
Figure 3:
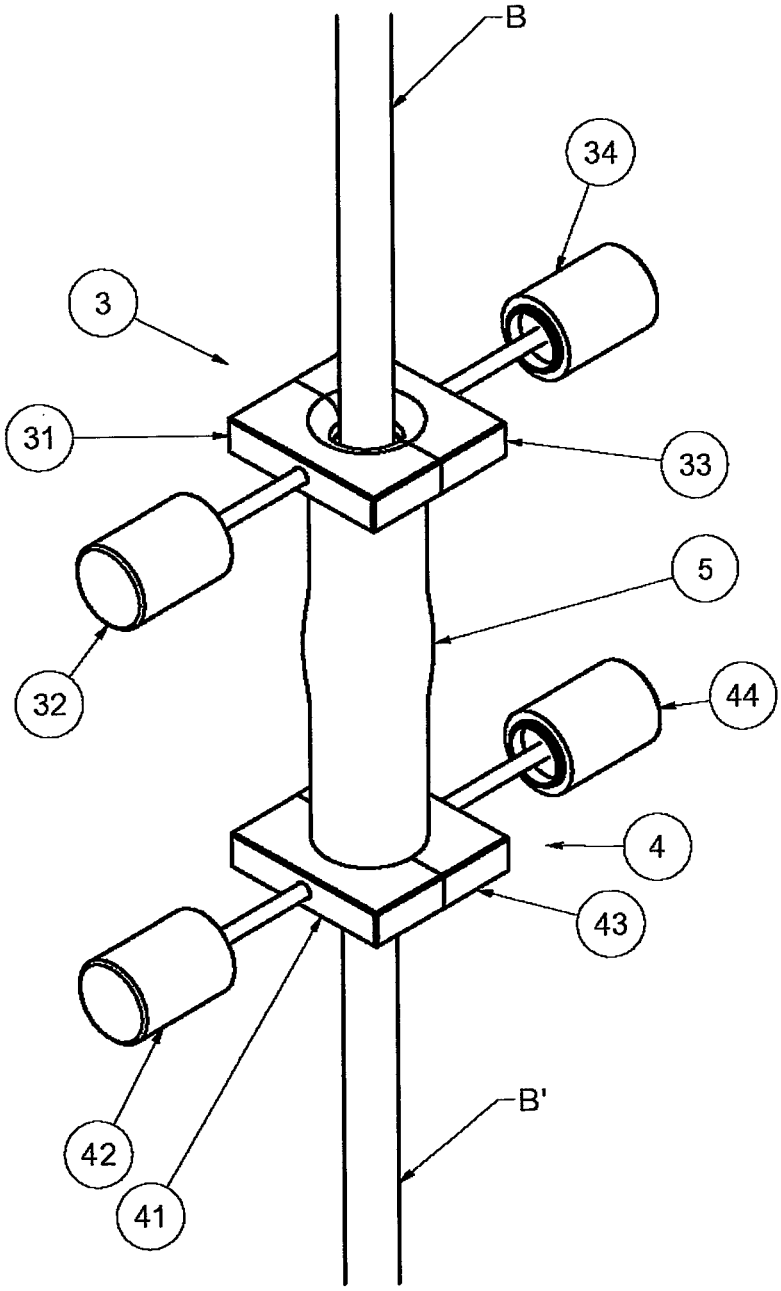
FIG. 3 depicts the stuffing box sealing element arranged between the upper and lower support plate halves provided with hydraulic cylinders for actuation.

The sets 3 and 4 of support plates for the sealing element 5 take up axial forces and act as sealing faces against the ends of the internal sealing element 5 when the plate halves are in the inner position in the stuffing box 1 as appearing from FIGS. 2 and 3. The support plates for the sealing element 5 are placed in the upper 22 and the lower 24 ends respectively of the stuffing box housing 2 and centres the drill string B in the stuffing box 1 while at the same time holding the sealing element 5 axially in its place in the middle part 23 of the stuffing box with the support plate set 3 on the top side and the support plate set 4 on the underside of the sealing element 5.

Upper and lower sets of support plates, 3 and 4 consist of two halves, each having a semi circular cut-out, so that the halves together form an aperture in the centre of the stuffing box 1 for passage of the drill pipes B, B' and tool joints B". Each of the support plate halves 31/33 and 41/43 may be pushed together or pulled apart by means of a hydraulic cylinder 32/34 and 42/44 respectively, the hydraulic cylinders typically being operated by water hydraulics.

The middle part of the stuffing box housing 23 is provided with several pressure ports 27 for supply of pressurised seawater via pipe connections 28 on the outside of the housing 2. The liquid pressure shall via the annulus 26 provide pressure assistance to the sealing element 5 sealing against the pipe.

The sealing element 5 is designed as a sleeve with an axial hole for the drill string B. It is an important principle that the sealing element 5 shall squeeze tightly around the drill string B and rotate with this to eliminate rotational wear on the inside of the sealing element 5. Thus, it is only axial movement of the drill string B that causes wear on the inside part of the packer 5. The outside of the sealing element rotates frictionless in the stuffing box. Rotational friction will arise in the area where the ends of the sealing element 5 is squeezed against the surfaces of the two sets 3, 4 of support plates which preferably are made from a ceramic material to obtain a high wear resistance. The inside and the ends of the sealing element 5 are wear reinforced with cast-in ceramic elements to resist axial friction from the pipe and rotational wear against the sealing surface on the two sets 3, 4 of support plates. Liquid from the annulus 26 ingressing between the ends of the sealing element 5 and the support plates 3, 4 will contribute to lubricate the sliding surface.

As long as the stuffing box 1 operates toward an open well, i.e. that the BOP is open toward the well, the annulus 26 in the middle part of the stuffing box housing 23 shall be pressurised with water hydraulics with filtered seawater as the medium, and the sealing element 5 is thereby forced radially against the drill string B and it will also result in the ends of the sealing element 5 being forced harder against the support plates 3 and 4. The lower end of the sealing element 5 seals against the lower support plate 4 and shall resist the pressure from the well, typically 50 bar.

There is included one or more accumulators (not shown) having pressurised reserve liquid in the control system. Since the medium injected for providing pressure assistance to the sealing element is seawater, there will be no environmental problems related to spills. The pressure in the annulus is regulated automatically relative to the well pressure on the underside of the stuffing box 1.

The support plate halves 31/33 and 41/43 are pulled out to the sides of the stuffing box 1 by the cylinders 32/34 and 42/44 respectively in connection with entering or pulling of the drill bit A with the reamer C sitting at the end of the drill string B. Simultaneously with this operation the stuffing box 5 is also installed in or pulled out of the stuffing box 1.

After entering of the drill bit A with the reamer C, through the stuffing box 1 and into the BOP on the underside of the stuffing box, the lower set of support plates 4 is closed around the drill string B and the sealing element 5 arranged on the drill string B is pulled into the stuffing box 1 until it stops against the lower set of support plates 4 and is forced against this due to the friction between the drill pipe and the sealing element 5. With the sealing element inside the stuffing box the upper set of support plates 3 is closed above the sealing element 5 and contributes to axial compression thereof, thereby providing sufficient contact pressure between the ends of the sealing element and the support plate sets 3 and 4.

Both sets of support plates 3 and 4 are opened when the drill string is to be pulled out of the well and the drill bit A with the reamer C is to be moved up through the stuffing box 1. As will be seen from FIG. 1 the sealing element 5 goes with the drill string B up to the surface and is inspected and possibly replaced if necessary before the next drilling operation.

The invention claimed is:

1. A cylindrical, hollow stuffing box (1) arranged to be able to take up geometrical differences between drill pipes (B) and tool joints (B'), characterised in that the stuffing box (1) comprises an outer housing (2), an upper and a lower set of support plates (3, 4) and also a sleeve-shaped, flexible sealing element (5) arranged rotationally between said support plates (3, 4) and enclosed by a liquid filled, pressurised annulus (26) which in a fluid sealing manner is defined by a central part (23) of the stuffing box housing (2), the outside of the sealing element (5) and said support plates (3, 4);

each of the upper and lower support plate sets (3, 4) comprise two halves (31, 33; 41, 43 respectively) connected to an actuator each (32, 34; 42, 44 respectively) arranged for radial displacement of the halves ((31, 33; 41, 43);

each of the support plate halves (31, 33; 41, 43) comprise a cut-out arranged to be able to encircle a peripheral portion of the drill string (B); and the inside and the ends of the sealing element (5) comprise cast-in, ceramic elements.

2. A method for running a drill pipe (8) through a stuffing box (1) according to claim 1, characterised in that the method comprises the following steps:

to lead a sealing element (5) onto the drill pipe (B) so that the sealing element (5) is positioned over the drill bit (A) and a possible reamer (C) connected to the drill bit (A);

to lead the drill bit (A) through the stuffing box (1);

to displace plate halves (41, 43) of a lower support plate (4) against a peripheral portion of the drill string (B);

to lead the sealing element (5) into the stuffing box (1) to abutment against the lower support plate (4);

to displace plate halves (31, 33) of an upper support plate (3) against a peripheral portion of the drill string (B);

to pressurise an annulus (26) enclosing the sealing element (5) with liquid from the outside of a stuffing box housing (2), so that the sealing element (5) is brought to sealing abutment against the drill string (B) while the ends of the sealing element (5) close tightly against the upper and the lower support plates (3, 4);

to rotate the sealing element (5) together with the drill string (B);

to pull the drill string (B) together with the sealing element (5) out of the stuffing box (1) as the halves (31, 33; 41, 43) of the support plates (3, 4) are displaced away from the drill string to let the drill bit (A) and any reamer (C) through the stuffing box (1).

3. A method according to claim 2, wherein the method comprises the further step:

to pressurise a space behind the support halves (31, 33; 41, 43) after having brought the support plates (3, 4) against the drill string (B).

4. A method according to claim 3, wherein the space behind the support halves (31, 33; 41, 43) is pressurised with filtered seawater.

5. A method according to claim 3, wherein the space behind the support halves (31, 33; 41, 43) is ventilated before the support halves (31, 33; 41, 43) are pulled away from the drill string (B).

* * * * *